US007780263B2

(12) United States Patent
Katayama

(10) Patent No.: US 7,780,263 B2
(45) Date of Patent: Aug. 24, 2010

(54) HEAD FOR LIQUID DISCHARGING APPARATUS

(75) Inventor: Naoki Katayama, Kariya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 450 days.

(21) Appl. No.: 11/903,620

(22) Filed: Sep. 24, 2007

(65) Prior Publication Data

US 2008/0225084 A1 Sep. 18, 2008

(30) Foreign Application Priority Data

Sep. 25, 2006 (JP) ..... 2006-258303

(51) Int. Cl.
*B41J 2/14* (2006.01)

(52) U.S. Cl. ..... 347/47; 347/19; 347/20; 347/44

(58) Field of Classification Search ..... 347/19–21, 347/44, 47
See application file for complete search history.

(56) References Cited

U.S. PATENT DOCUMENTS 7,128,404 B2 * 10/2006 Kodama ..... 347/68
7,168,792 B2 1/2007 Ito
2005/0093931 A1 * 5/2005 Kodama ..... 347/54
2006/0044359 A1 3/2006 Sugahara
2009/0207210 A1 * 8/2009 Imanaka et al. ..... 347/58

FOREIGN PATENT DOCUMENTS

JP 2005096171 4/2004
JP 2006096034 4/2006

* cited by examiner

*Primary Examiner*—Ellen Kim
(74) *Attorney, Agent, or Firm*—Eugene LeDonne; Joseph W. Trelaor; Frommer Lawrence & Haug LLP

(57) ABSTRACT

A head for a liquid discharging apparatus includes a cavity unit having a cavity plate in which pressure chambers are formed and a vibration plate and a base plate which are joined to upper and lower surfaces of the pressure chambers respectively. In a joining surface of the cavity plate and the vibration plate and in a joining surface of the cavity plate and the base plate, test grooves are formed corresponding to column portions which partition mutually adjacent pressure chambers among the plurality of pressure chambers, and communication grooves capable of supplying air communicate with the respective test grooves. By supplying air to the respective test grooves through the communication grooves and detecting a change in supply pressure thereof, it is possible to test a joint state of the cavity plate with the vibration plate and with the base plate at the column portions.

10 Claims, 9 Drawing Sheets

HEAD FOR LIQUID DISCHARGING APPARATUS

CROSS-REFERENCE TO RELATED APPLICATIONS

This application claims priority from Japanese Patent Application No. 2006-258303, filed on Sep. 25, 2006, the disclosure of which is incorporated herein by reference in its entirety.

BACKGROUND OF THE INVENTION

1. Field of the Invention

The present invention relates to a head for a liquid discharging apparatus such as a head for an ink-jet printer.

2. Description of the Related Art

Conventionally, there is known an ink-jet head in which a plurality of metal etching members are coupled by a metal diffusion bonding method to form ink channels (see, for example, US Patent Application Publication No. 2006/0044359 (corresponds to Japanese Patent Application Laid-open No. 2006-96034, paragraphs 0039 to 0040)).

Such a head has a high fixing strength and a high stiffness, and for which a heating step can be used since a resin adhesive is not used.

However, since the head is difficult to be decomposed after joining, it is difficult to locate a leak position when a defective head is produced. Also, in particular, a leak to an adjacent cavity in a column portion between cavities to form pressure chambers is not tested, and there may even be a case that a defective head is assembled into a printer body as it is.

Incidentally, there is known a test method for an ink-jet printer head in which, between rows of pressure chambers, there is formed a distribution groove for testing, which extends along the rows of the pressure chambers and communicates with the outside, and a sealing leak between the rows of the pressure chambers can be tested securely within a short time (see, for example, U.S. Pat. No. 7,168,792 (corresponds to Japanese Patent Application Laid-open No. 2005-96171, paragraphs [0038] to [0040] and FIG. 2 to FIG. 5)).

However, in the ink-jet printer head described in U.S. Pat. No. 7,168,792, since the distribution groove for testing is formed only between the rows of the pressure chambers, it is not possible to test a leak to an adjacent cavity in a column portion between cavities to form the pressure chambers.

SUMMARY OF THE INVENTION

An object of the present invention is to provide a head for a liquid discharging apparatus in which a leak to an adjacent cavity can be tested in a column portion between cavities to form pressure chambers.

According to a first aspect of the present invention, there is provided a head for a liquid discharging apparatus which discharges a liquid, the head including a cavity unit including: a plurality of nozzles arranged in a row in a surface; a plurality of pressure chambers arranged in a row corresponding to the nozzles respectively; a liquid channel which distributes the liquid from a liquid supply hole to each of the pressure chambers and supplies the liquid to each of the nozzles; a first plate forming the pressure chambers; and second plates joined to both surfaces of the first plate respectively, wherein column portions are provided to partition mutually adjacent pressure chambers among the plurality of pressure chambers, and test grooves are formed corresponding to the column portions in at least one of the first plate and the second plates, and a communication groove capable of supplying air communicates with the respective test grooves. Here, a head in the case where there is one nozzle row is included.

With this structure, by supplying air to the respective test grooves via the communication groove and observing a change in supply pressure of the air, it is possible to test easily whether the first plate and the second plates are joined favorably or not at the column portions which partition the mutually adjacent pressure chambers. Since it is thus possible to know whether the joining is performed favorably or not by just supplying air to the test grooves through the communication groove, it is particularly effective for testing appropriateness of a joint in a large amount of products efficiently within a short time.

In the head for the liquid discharging apparatus of the present invention, in the cavity unit, the first plate and the second plates may be joined by metal diffusion bonding. With this structure, it is possible to test easily whether the first plate and the second plates are joined favorably or not at the column portions by metal diffusion bonding.

In the head for the liquid discharging apparatus of the present invention, each of the pressure chambers may be formed of a through hole which is formed in the first plate and the second plates which are joined to the both surfaces of the first plate; and each of the test grooves may have a first test groove formed in a joining surface of the first plate with one of the second plates and a second test groove formed in a joining surface of the first plate with the other one of the second plates, and the first and second test grooves may communicate with the communication grooves. With this structure, it is possible to test simultaneously using the communication groove whether the first plate and the second plates are joined favorably or not at portions of upper and lower faces of the column portions.

In the head for the liquid discharging apparatus of the present invention, the communication groove may have a first communication groove communicating with the first test groove and a second communication groove communicating with the second test groove. With this structure, it is possible to detect a leak from the first test groove by supplying air only to the first communication groove, and it is possible to detect a leak from the second test groove by supplying air only to the second communication groove.

In the head for the liquid discharging apparatus of the present invention, the first test groove may be formed in one surface of the first plate, and the second test groove may be formed in the other surface of the first plate. With this structure, since the first and second test grooves are formed in the surfaces of the first plate respectively, the first and second test grooves are formed securely even when positional displacement or shift occurs in joint positions of the second plates and the first plate.

In the head for the liquid discharging apparatus of the present invention, the test grooves may be formed in at least one of a joining surface of the first plate with one of the second plates and a joining surface of the first plate with the other one of the second plates. When a joint failure occurs for example in a biased manner in only one of the two joining surfaces of the first plate, the joint failure can be detected efficiently by forming the test grooves only in the one joining surface.

The head for the liquid discharging apparatus of the present invention may further include a through passage which communicates the first communication groove and the second communication groove. With this structure, air can be supplied sequentially to the first communication grooves and the second communication grooves.

In the head for the liquid discharging apparatus of the present invention, the test grooves may be formed in the column portions by half etching. With this structure, by forming the test grooves by half etching, joint portions of the column portions of the first plate and the second plates can be positions near the pressure chambers rather than central portions of the column portions. Accordingly, besides the function as a test groove to test a leak, it is also possible to exhibit a function to eliminate a leak by securely joining vicinities of the pressure chambers. For example, in the case of metal diffusion bonding, a pressurizing load due to the joining concentrates on both left and right side portions of the recessed groove portions, namely the vicinity of the cavity, rather than the central portions of the column portions, and hence stable joining becomes possible between peripheries of the respective cavities in the cavity plate and the vibration plate, thereby eliminating the fear of a leak of discharge pressure from the cavities.

In the head for the liquid discharging apparatus of the present invention, the communication grooves may extend in a row direction of the row of the pressure chambers on each of both sides of the pressure chambers. With this structure, the communication groove capable of supplying air to the test grooves can be arranged with respect to the test grooves without a trouble. Further, a leak between rows of the pressure chambers can also be detected by the communication groove.

In the head for the liquid discharging apparatus of the present invention, the plurality of nozzles may be formed in a nozzle plate joined to the cavity unit, the cavity unit may have a test opening which communicates with the communication groove, and the test opening may be closed by the nozzle plate. With this structure, the test grooves after the test has been finished can be made as sealed spaces, and hence entering of the liquid or the like from the test opening can be prevented.

DETAILED DESCRIPTION OF THE PREFERRED EMBODIMENTS

Hereinafter, an embodiment of the present invention will be explained based on the drawings, taking an example of a head for an ink-jet printer.

Figure 1A:
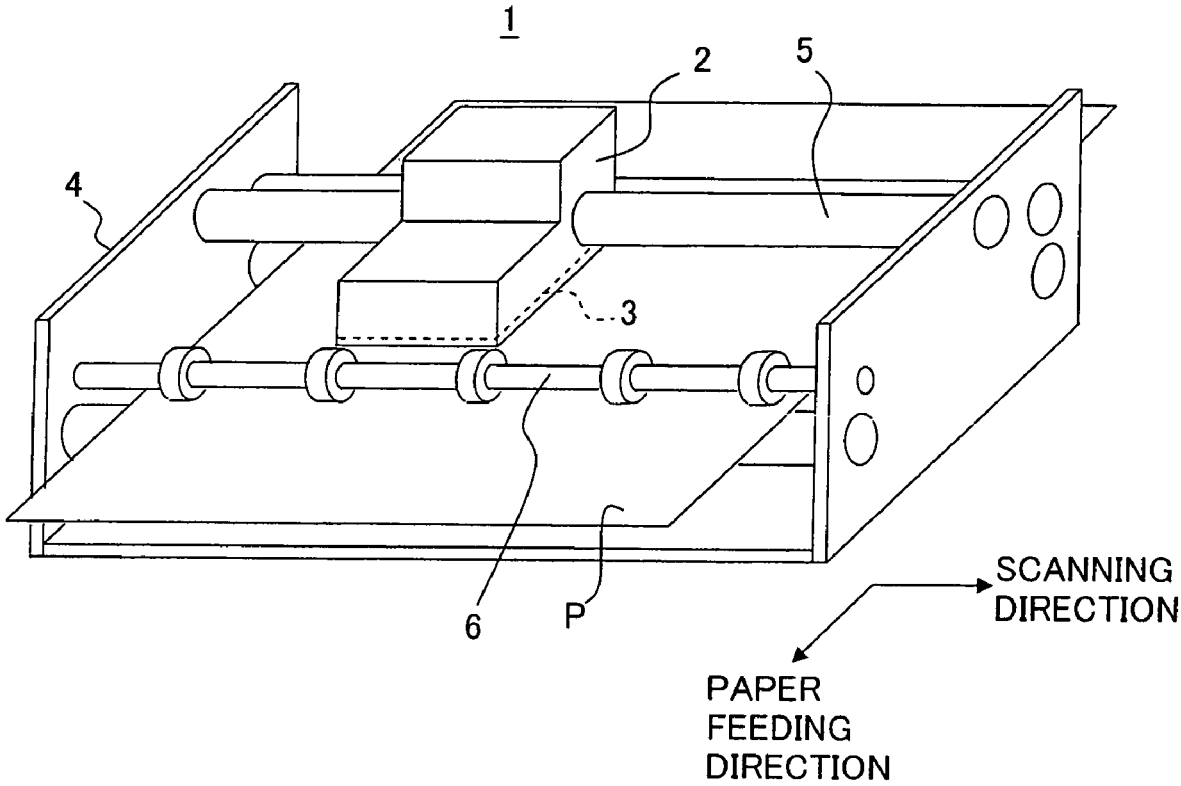
FIG. 1A is a schematic structure view of an ink-jet printer according to the present invention.
Figure 1B:
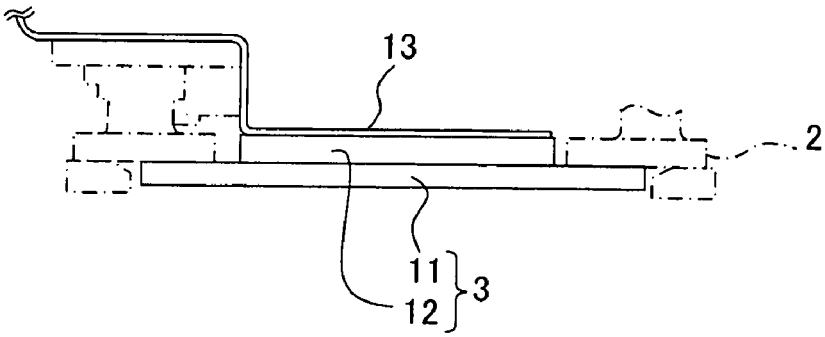
FIG. 1B is an explanatory view showing an arrangement relationship among a cavity unit, an actuator unit and a flexible cable (COP) according to the present invention.

FIG. 1A is a schematic structure view of an ink-jet printer according to the present invention, and FIG. 1B is an explanatory view showing an arrangement relationship among a cavity unit, an actuator unit and a flexible cable (COP) according to the present invention.

In an ink-jet printer 1 according to the present invention, as shown in FIG. 1A, there is provided a head 3 for an ink-jet printer (hereinafter, simply referred to as a head for a printer) for recording on a recording paper P (recording medium) on a lower surface of a carriage 2 on which an ink cartridge (not shown) is mounted. The carriage 2 is supported by a carriage shaft 5 and a guide plate (not shown) provided in a printer frame 4, and reciprocates in a scanning direction which is orthogonal to a paper feeding direction for the recording paper P.

The recording paper P is carried in the paper feeding direction from a not-shown paper feeding unit. Namely, the recording paper P is introduced between a platen roller (not shown) and the head 3 for a printer, predetermined recording is performed by ink jetted toward the recording paper P from the head 3 for a printer, and the recording paper P is discharged by a discharge roller 6.

Figure 2A:
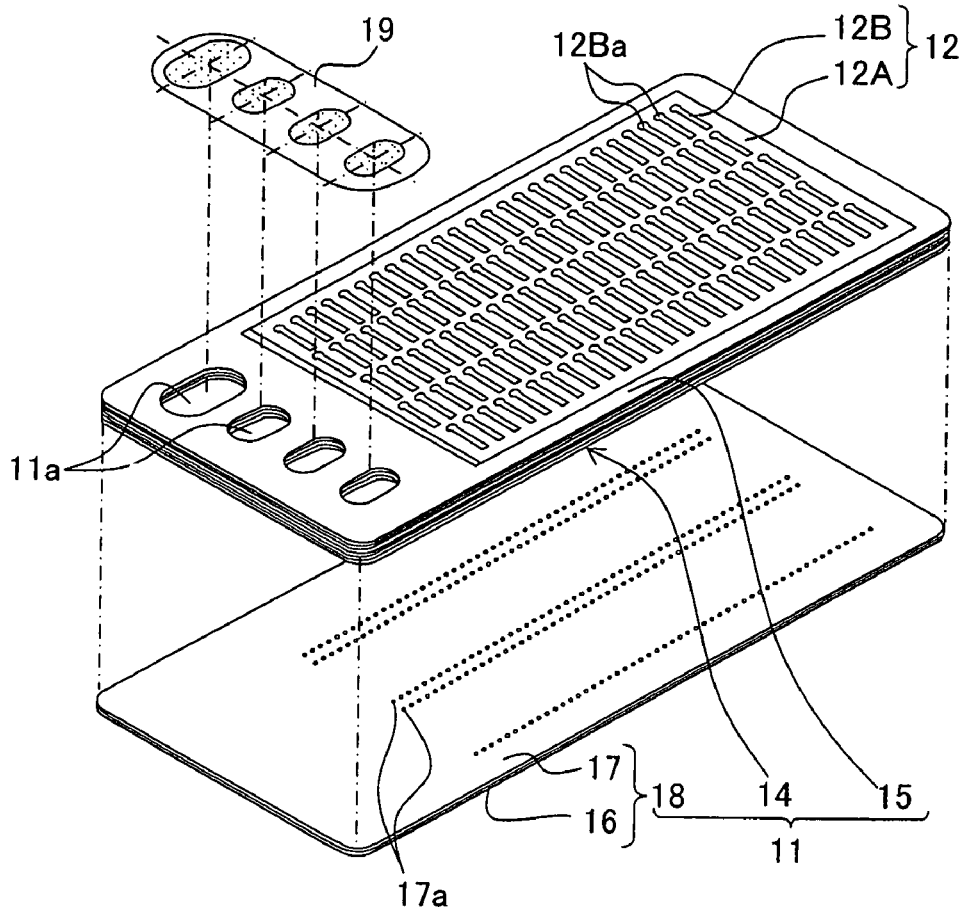
FIG. 2A is an exploded perspective view showing a state that the actuator unit is adhered to the cavity unit.
Figure 2B:
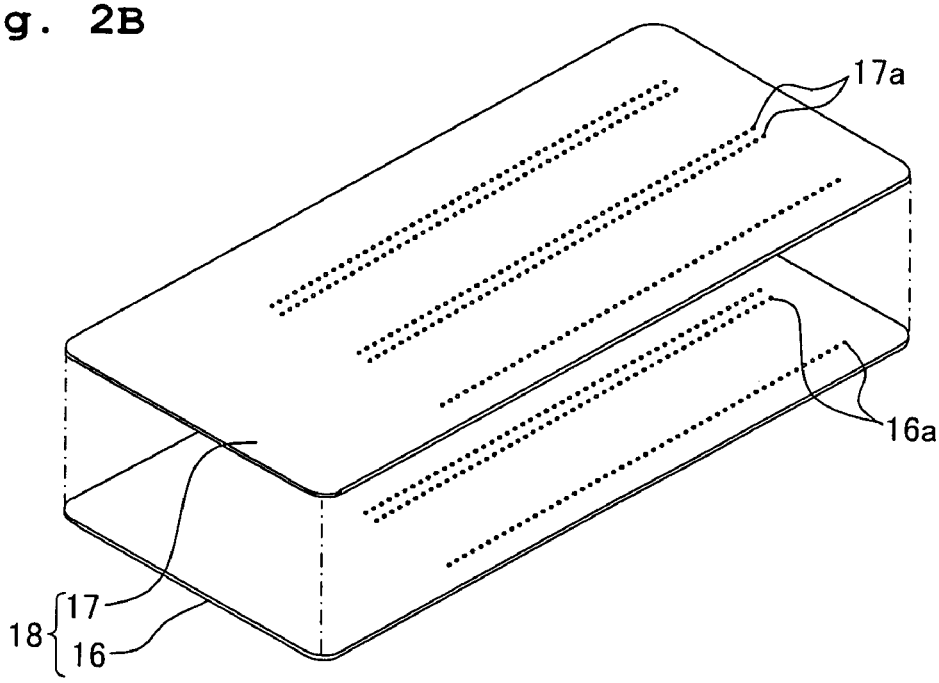
FIG. 2B is an exploded perspective view of a plate assembly constructed by adhering a nozzle plate and a spacer plate.

Also, as shown in FIG. 1B and FIG. 2A, the head 3 for a printer includes a cavity unit 11 and an actuator unit 12, and is provided with a flexible cable 13 (signal line), which supplies a drive signal, on a surface of the actuator unit 12 which does not face the cavity unit 11. In the following explanation, a direction in which the cavity unit 11 and the actuator unit 12 are stacked is referred to as a vertical direction.

The cavity unit 11 includes a stack 14 constituted of a plurality of plate members. On an upper side of the stack 14, a vibration plate 15 which will be explained later is provided. Meanwhile, on a lower side thereof, there is adhered integrally a plate assembly 18 which is formed by adhering a nozzle plate 16 having a plurality of nozzles 16*a* formed in rows in a surface and a spacer plate 17 having a through holes 17*a* corresponding to the nozzles 16*a*. Then, on an upper side of the vibration plate 15, the actuator unit 12 is provided (see FIG. 1B). Also, as shown in FIG. 2A, a filter 19 for filtering dust or the like included in ink is provided on openings 11*a* of the cavity unit 11. The nozzle plate 16 is a synthetic polymer resin plate (polyimide for example) in which one nozzle 16*a* is provided for one pressure chamber 14Aa respectively in a cavity plate 14A (constituting the stack 14) which will be explained later. Such a nozzle 16*a* is formed by performing excimer laser processing on the synthetic polymer resin plate. Thus, the cavity unit 11 has ink channels which distribute ink from ink supply holes 11*a* to the respective pressure chambers 14Aa, and supply the ink to the respective nozzles 16*a*.

Figure 3A:
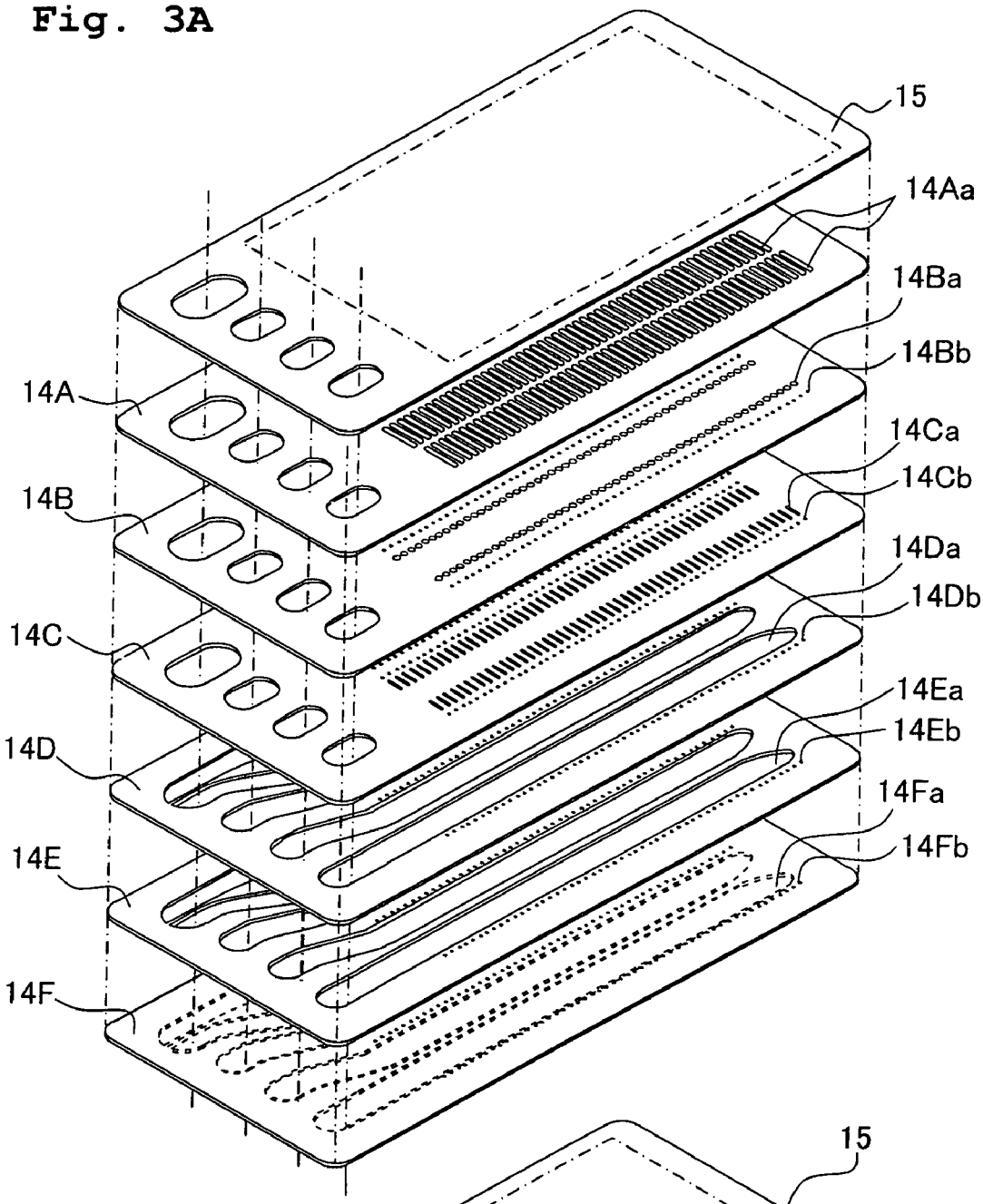
FIG. 3A is an exploded perspective view showing the cavity unit exploded to respective plates as components together with a vibration plate.
Figure 3B:
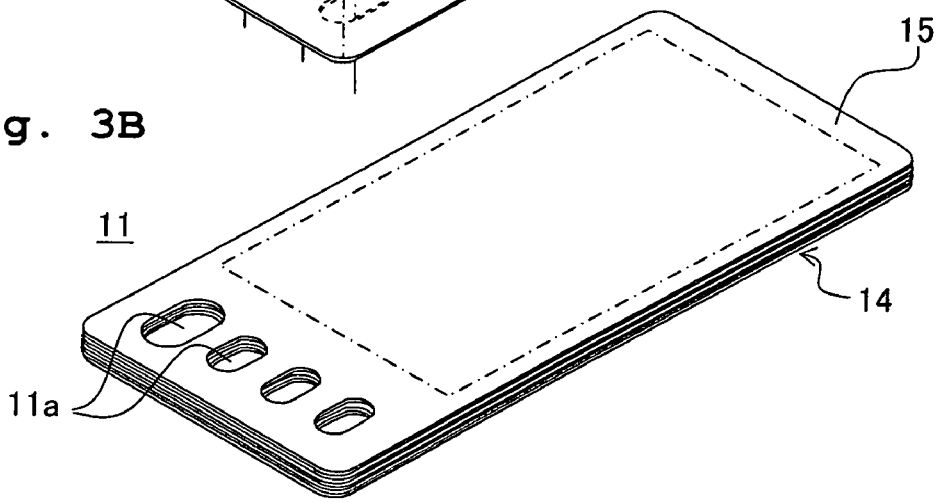
FIG. 3B is a perspective view of a joined cavity unit.

As shown in FIGS. 3A and 3B, this stack 14 includes a cavity plate 14A (first plate), a base plate 14B, an aperture plate 14C, two manifold plates 14D, 14E, and a damper plate 14F stacked in order from an upper side. These six plates 14A to 14F are positioned and stacked so that openings formed respectively therein form individual ink channels for respective nozzles 16*a*. The plates 14A to 14F constituting the stack 14 are rectangular metal plates, and further a vibration plate 15 which is a metal plate is stacked on the stack 14 and metal diffusion bonded thereto.

Figure 4:
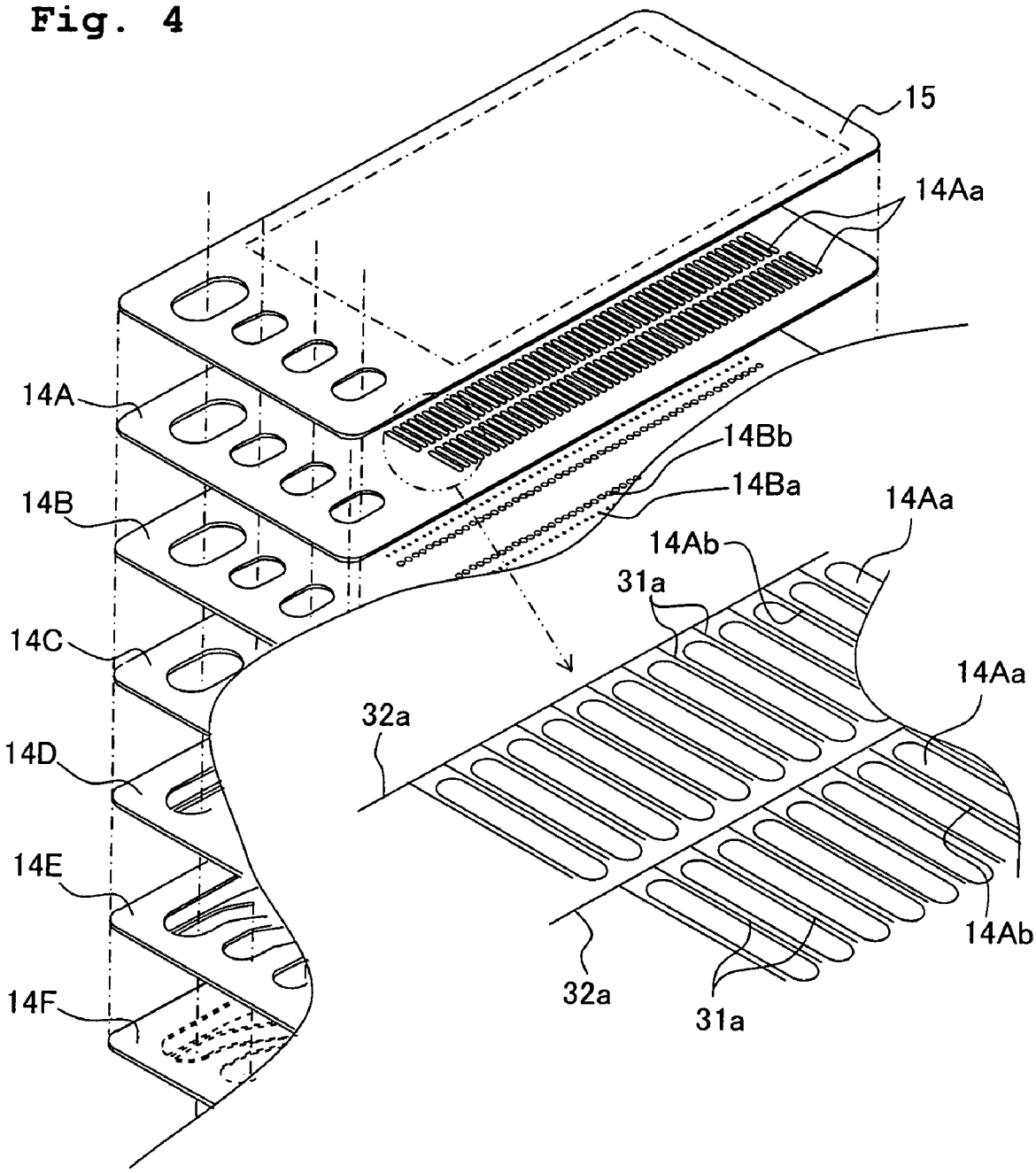
FIG. 4 is an enlarged perspective view of a main part showing a relationship between test grooves and communication grooves.

As shown in FIG. 4, in the cavity plate 14A, a plurality of cavities to form the pressure chambers 14Aa are arranged in rows corresponding to the respective nozzles 16*a* in a plate longitudinal direction thereof. The plurality of pressure chambers 14Aa (cavities) are formed by etching as through holes penetrating in a plate thickness direction. Then, the vibration plate 15 and the base plate 14B as second plates are joined to upper and lower surfaces of this cavity plate 14A (first plate), respectively. In the upper and lower surfaces of the cavity plate 14A, as shown in FIG. 4 and FIGS. 5A to 5C respectively, at positions corresponding to column portions 14Ab which partition the pressure chambers 14Aa adjacent to each other in a row direction, test grooves 31*a*, 31*b* for testing a leak between the pressure chambers 14Aa adjacent to each other are formed respectively. Common communication grooves 32*a* capable of supplying air to the respective test grooves 31*a* communicate with the respective test grooves 31*a*. Also, common communication grooves 32*b* capable of supplying air to the respective test grooves 31*b* communicate with the respective test grooves 31*b*.

Figure 5A:
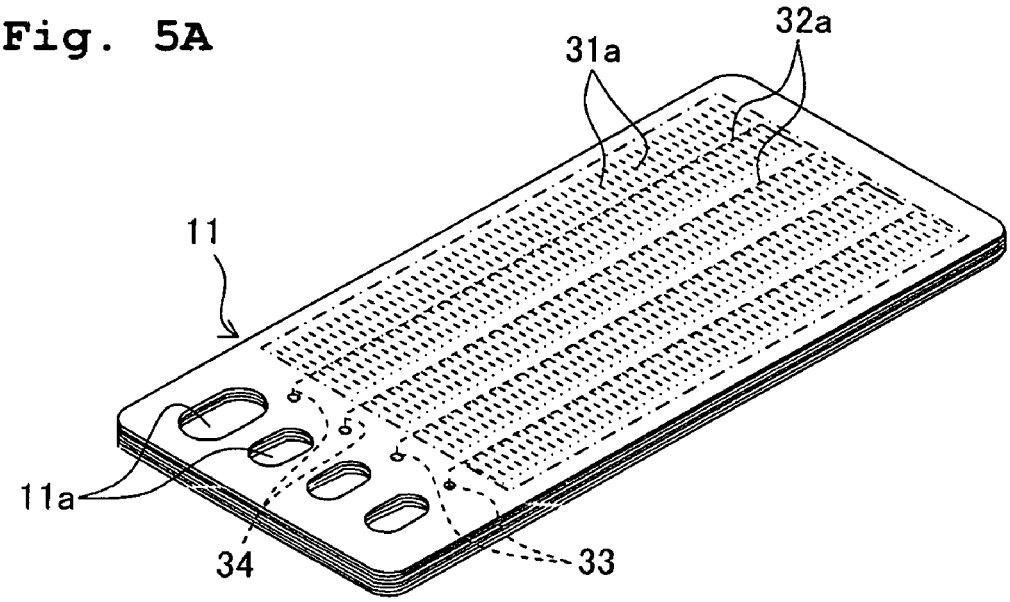
FIG. 5A is a perspective view showing an upper surface of the cavity unit.
Figure 5B:
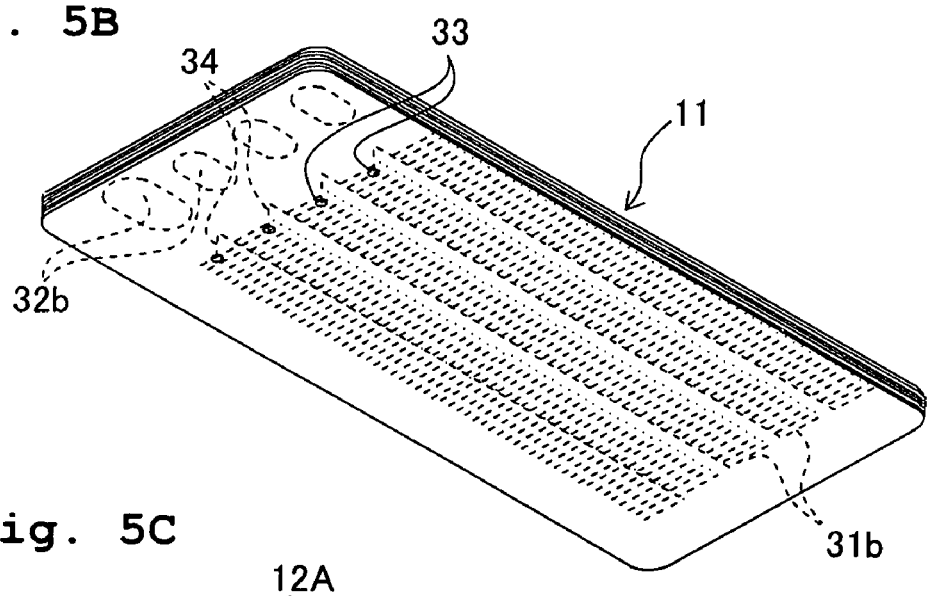
FIG. 5B is a perspective view showing a lower surface of the cavity unit.

FIG. 5A and FIG. 5B show the test grooves 31*a*, 31*b*, the communication grooves 32*a*, 32*b*, through passages 34 communicating with the communication grooves 32*a*, 32*b*, and test openings 33, which are formed inside the cavity unit 11. Since these test grooves 31*a*, 31*b*, communication grooves 32*a*, 32*b*, through passages 34, and test openings 33 are not exposed on a surface of the cavity unit 11, they are shown by dotted lines.

Figure 5C:
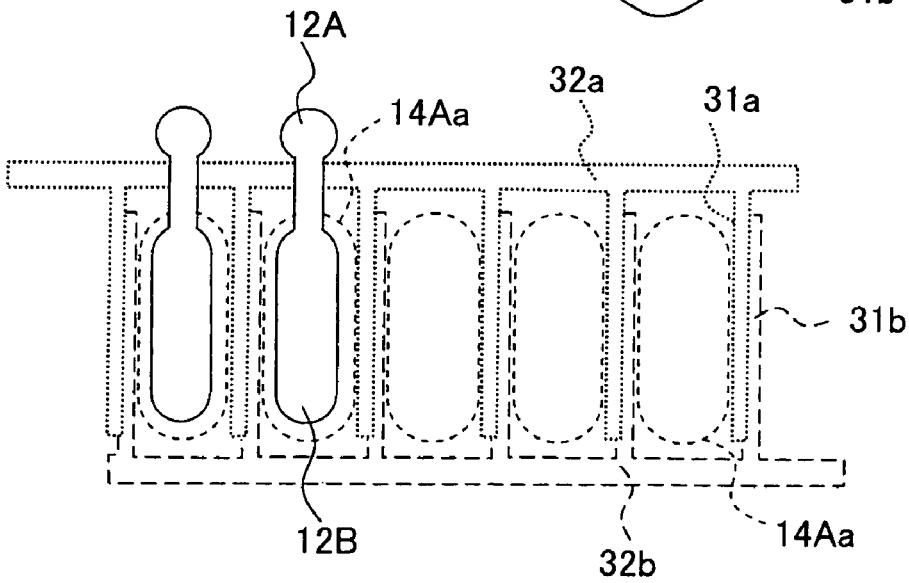
FIG. 5C is an explanatory view of an arrangement relationship between test grooves and communication grooves.

The test grooves 31*a*, 31*b* are formed by half-etching in the upper and lower surfaces of the column portions 14Ab, and the communication grooves 32*a*, 32*b* which allow communication of the test grooves 31*a*, 31*b* and having a larger groove width than the test grooves 31*a*, 31*b* are arranged on both sides of the respective pressure chambers 14 Aa in the row direction, as details thereof are shown in FIGS. 5A, 5B. Then, while the communication grooves 32*a* are formed in the upper surface of the cavity plate 14A, the communication grooves 32*b* are formed in a lower surface of the base plate 14B, and both the communication grooves 32*a*, 32*b* extend in parallel in the row direction of the pressure chambers 14Aa. Both the communication grooves 32*a*, 32*b* have ends connected to the through passages 34 penetrating through the base plate 14B, the aperture plate 14C, the manifold plates 14D, 14E, and the damper plate 14F, and finally open in a lower surface of the stack 14 (lower surface of the damper plate 14F) as the test openings 33. Therefore, it is also possible to detect a leak between pressure chamber rows adjacent to each other by the communication grooves 32*a*, 32*b*. The test openings 33 are finally closed by joining of the plate assembly 18. Accordingly, the test grooves after the test has finished can be made as sealed spaces, and hence entering of liquid or the like from the test openings is prevented. Note that the test openings 33 are provided for respective ink colors, but it is also possible to allow communication of the upper and the lower communication grooves 32*a*, 32*b* and make one test opening. Also, as shown in FIG. 5C, the upper and the lower test grooves 31*a*, 31*b* may be arranged to shift slightly in a width direction of the column portions 14Ab.

Figure 6:
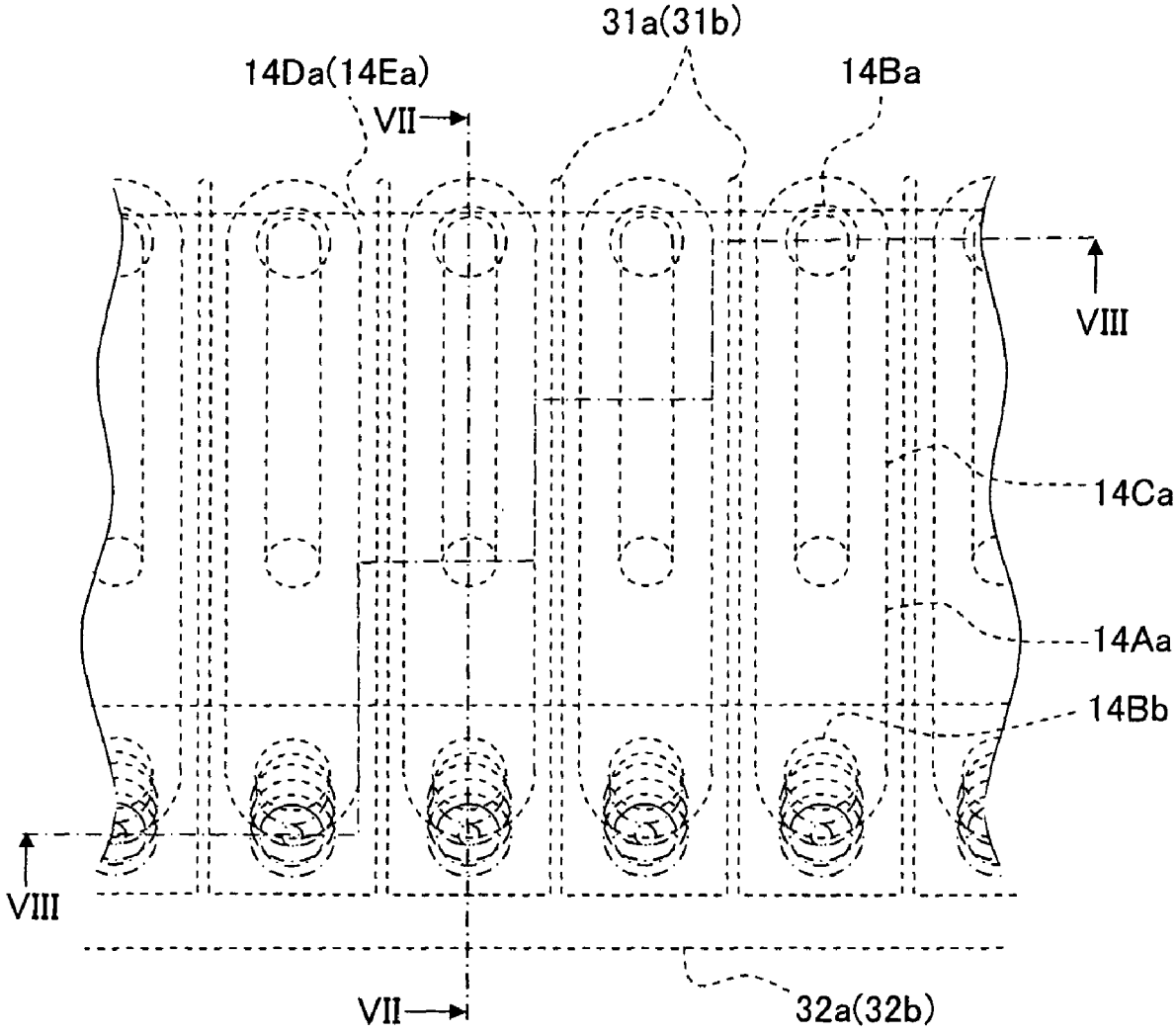
FIG. 6 is an enlarged view of a main part of a stack seen from an upper side.
Figure 7:
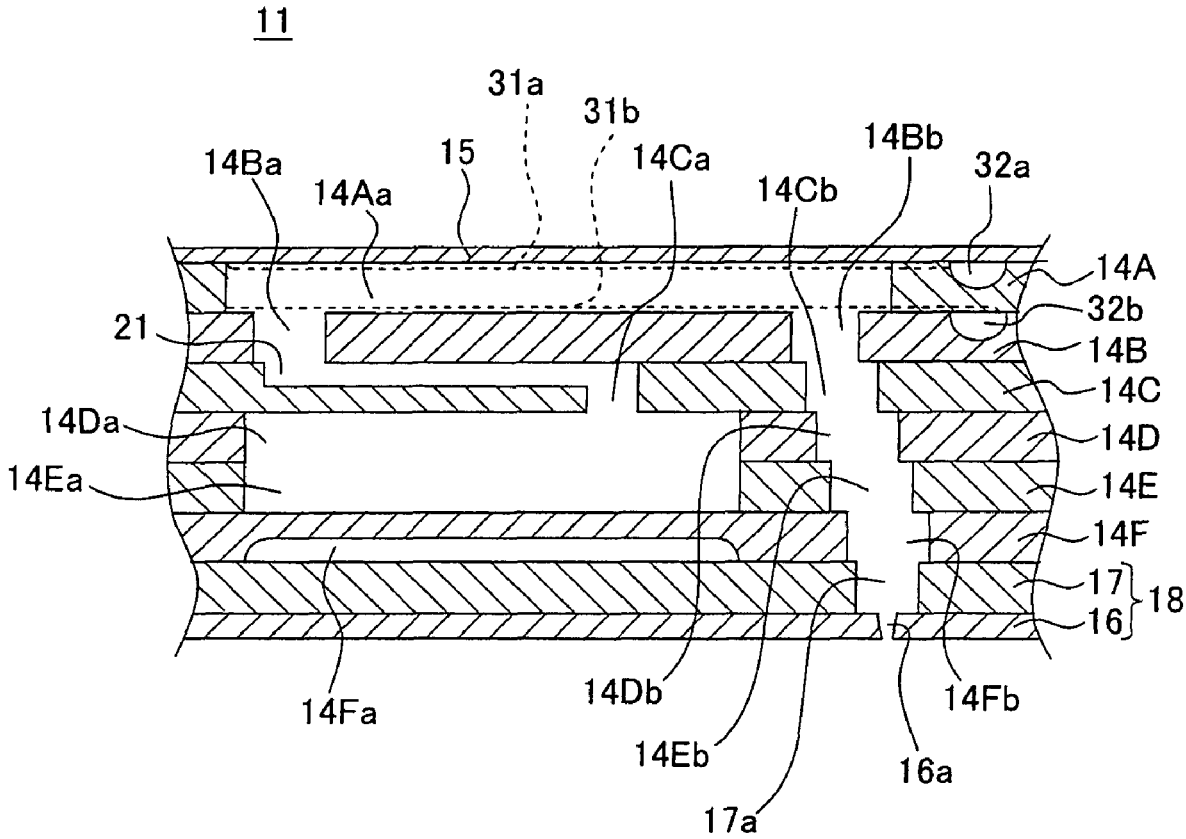
FIG. 7 is a cross-sectional view taken along the line VII-VII in FIG. 6.
Figure 8:
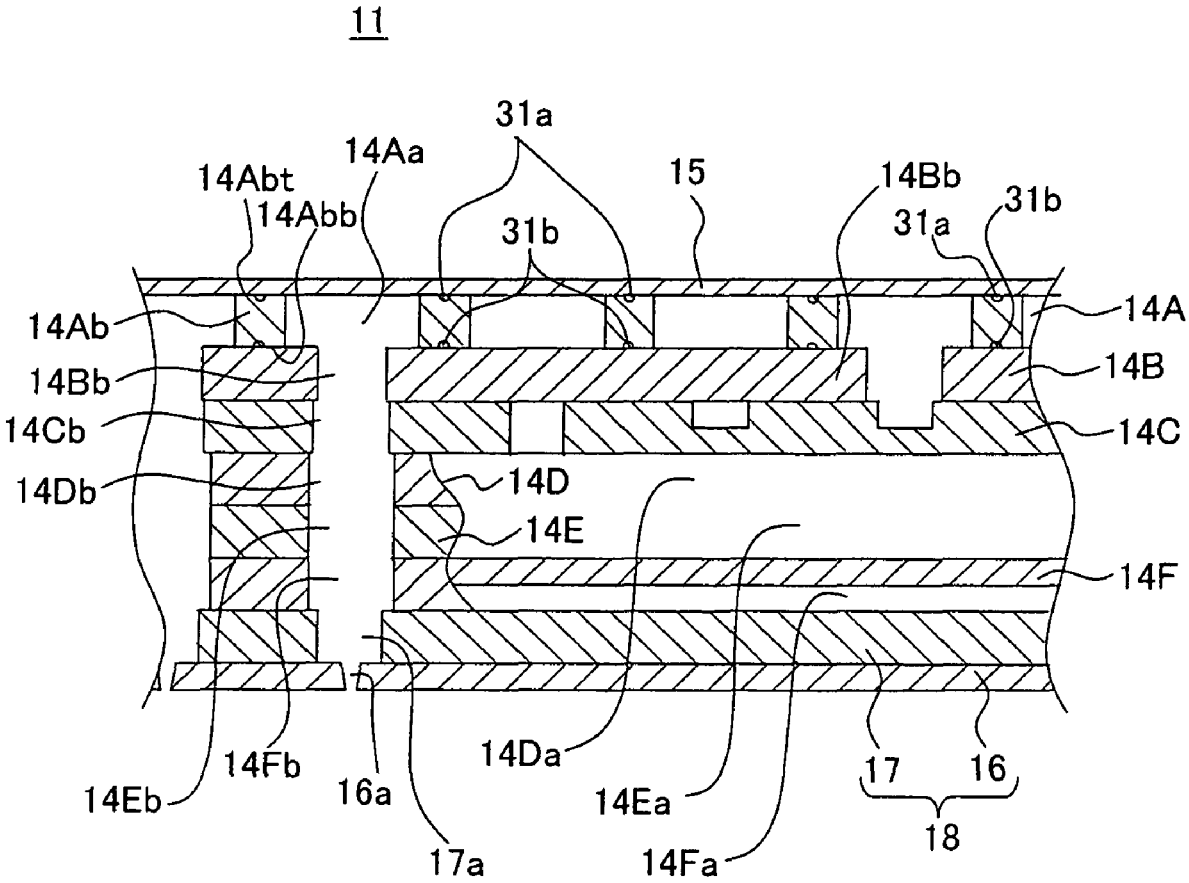
FIG. 8 is a cross-sectional view taken along the line VIII-VIII in FIG. 6.

Also, as shown in FIG. 6 to FIG. 8, the base plate 14B is a metal plate provided with communication holes 14Ba from manifolds 14Da, 14Ea (common ink chamber) to the respective pressure chambers 14Aa and communication holes 14Bb from the respective pressure chambers 14Aa to the respective nozzles 16*a*, respectively. The aperture plate 14C is a metal plate provided with communication passages 14Ca as recessed passages in an upper surface thereof, which allow communication of the respective pressure chambers 14Aa and the manifolds 14Da, 14Ea and communication holes 14Cb from the respective pressure chambers 14Aa to the nozzles 16*a*. The manifold plates 14D, 14E are metal plates provided respectively with, in addition to the manifolds 14Da, 14Ea, communication holes 14Db, 14Eb from the respective pressure chambers 14Aa to the respective nozzles 16*a*. The damper plate 14F is a metal plate provided with, besides damper chambers 14Fa formed as a recessed portion in a lower surface thereof, communication holes 14Fb which allow communication of the respective pressure chambers 14Aa and the respective nozzles 16*a*.

The actuator unit 12 includes a piezoelectric layer 12A formed on the vibration plate 15, and a plurality of individual electrodes 12B formed corresponding to the respective pressure chambers 14Aa on an upper side of the piezoelectric layer 12A. The plurality of individual electrodes 12B have an elliptic planar shape, which are smaller to some extent than the pressure chambers 14Aa, and are formed at positions overlapping in a plan view with central portions of the corresponding pressure chambers 14Aa respectively. Note that as shown in FIG. 6, in a surface of the piezoelectric layer 12A, regarding the respective individual electrodes 12B, a plurality of terminal portions 12Ba connecting to the respective individual electrodes 12B are formed, the plurality of terminal portions are connected electrically to a driver IC (not shown) via a flexible cable 13, and a drive voltage is supplied selectively from the driver IC to the plurality of individual electrodes 12B via the terminal portions.

The vibration plate 15 is arranged facing the plurality of individual electrodes 12B, and also functions as a common electrode which makes an electric field act in the piezoelectric layer 12A between the individual electrodes 12B and the cavity plate 14A. The piezoelectric layer 12A is constituted of a ceramic material based on lead zirconate titanate (PZT) having ferroelectricity and is polarized in a thickness direction thereof. The individual electrodes 12B are constituted of a metal material based on Ag—Pd or the like, and are connected to the not-shown driver IC via signal lines of the flexible cable 13 in which a drive signal is supplied. On the other hand, the vibration plate 15 functioning as an internal common electrode is always kept at ground potential.

Therefore, by setting the potentials of the individual electrodes 12B higher than the ground potential, an electric field is applied to the piezoelectric layer 12A in a polarization direction thereof. The piezoelectric layer 12A to which the electric field is applied contracts as an active layer in an orthogonal direction with respect to the polarization direction by a piezoelectric lateral effect. On the other hand, since the vibration plate 15 does not contract by itself because the vibration plate 15 is not affected by an electric field, there is generated a difference in distortion in a direction perpendicular to the polarization direction between the piezoelectric layer 12A as an upper layer and the vibration plate 15 as a lower layer, which makes, accompanying with that the vibration plate 15 is fixed to the cavity plate 14A, the piezoelectric layer 12A and the vibration plate 15 deform to project toward the pressure chambers 14Aa (unimorph deformation). Accordingly, volumes in the pressure chambers 14Aa decrease and the pressure of the ink increases, and thereby the ink is jetted from the nozzles 16*a*. Thereafter, when the individual electrodes 12B are returned to the same potential as the common electrode (vibration plate 15), the piezoelectric layer 12A and the vibration plate 15 return to the original shapes and the volumes in the pressure chambers 14Aa return to the original volumes, and thereby ink is sucked in from the manifolds 14Da, 14Ea.

As described above, in this embodiment, since the vibration plate 15 is provided on the upper side of the cavity unit 11, excellent jetting efficiency can be realized by the unimorph deformation.

Next, a manufacturing method for the head 3 for an ink-jet printer will be explained.

First, the plates 14A to 14F constituting the stack 14 and the vibration plate 15 are joined integrally by metal diffusion bonding. Here, since the vibration plate 15 and the plates 14A to 14F are constituted of a metal material such as stainless steel, the through holes (pressure chambers 14Aa and so on), the test grooves 31*a*, 31*b*, and the communication grooves 32*a*, 32*b* can be formed easily by etching, press working, or the like. Also, since the vibration plate 15 also functions as a common electrode which faces the plurality of individual electrodes 12B and generates an electric field in the piezoelectric layer 12A, it is not necessary to provide a common electrode other than the vibration plate 15, which simplifies the structure of the piezoelectric actuator.

Figure 9A:
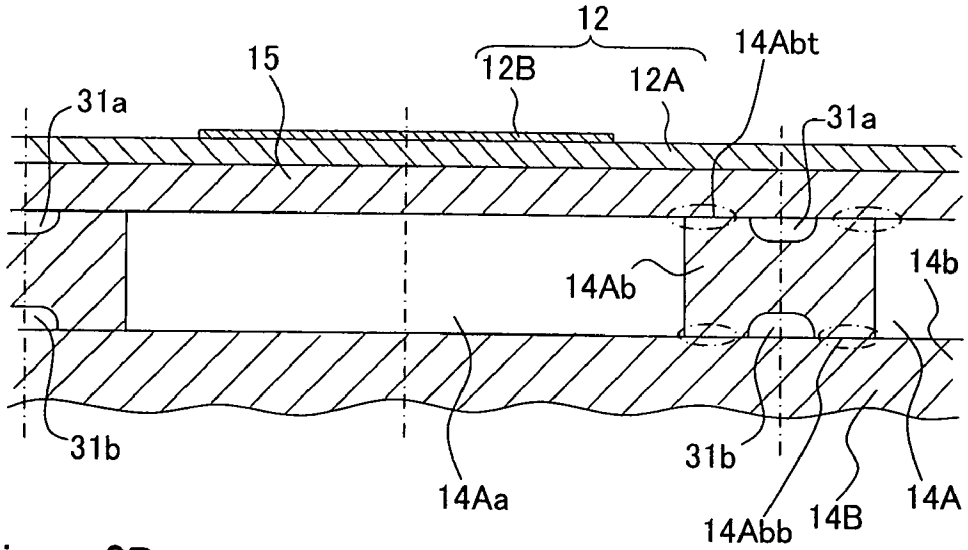
FIG. 9A is a cross-sectional view of a main part of the cavity unit for explaining a part where test grooves are formed.

In particular, since the test grooves 31*a*, 31*b* are provided in the upper surfaces (one surfaces) 14Abt and the lower surfaces (the other surfaces) 14Abb of the column portions 14Ab, solid portions extending in the thickness direction exist on both sides of the test grooves 31*a*, 31*b*. Accordingly, when performing the metal diffusion bonding, a pressurizing load is received not by the central portions of the column portions 14Ab (portions where the test grooves 31*a*, 31*b* are formed) but by the solid portions near the pressure chambers 14Aa. Therefore, the column portions 14Ab are joined stably without buckling. Namely, strong joining is made at portions circled by dashed lines in FIG. 9A. Further, since the test grooves 31*a*, 31*b* are formed in the upper surfaces 14Abt and the lower surfaces 14*abb* of the column portions 14*ab*, the test grooves 31*a*, 31*b* are formed securely even when positional displacement occurs in joint positions of the vibration plate 15 or the base plate 14B and the cavity plate 14A.

After the metal diffusion bonding is completed, by supplying compressed air to the respective test grooves 31*a*, 31*b* via the communication grooves 32*a*, 32*b* through the test openings 33 in a lower surface of the cavity unit 11 and observing a change in supply pressure of the air, it is possible to test easily whether the vibration plate 15 and the cavity plate 14A as well as the cavity plate 14A and the base plate 14B are joined favorably or not at the portions of the column portions 14Ab which partition the pressure chambers adjacent to each other. Namely, if there is no joint failure, the supply pressure of the air hardly changes, and hence the joint state can be determined as normal. On the other hand, if there is a joint failure, a leak occurs and the supply pressure of the air decreases, and hence it is possible to determine that the joint state is defective when decrease in the supply pressure is detected. Also, a leak from the test grooves 31*a* can be detected by supplying air to only the communication grooves 32*a*, and a leak from the test grooves 31*b* can be detected by supplying air only to the communication grooves 32*b*. Since it is thus possible to know whether the joining is performed favorably or not by just supplying air to the test grooves 31*a*, 31*b* through the communication grooves 32*a*, 32*b*, it is particularly effective for testing appropriateness of a joint in a large amount of products efficiently within a short time.

Next, to the cavity unit 11 in which the diffusion bonding is favorably made, the piezoelectric layer 12A is formed on a surface of the vibration plate 15 opposite to the stack 14. Here, an aerosol deposition method (AD method) is used for formation of the piezoelectric layer 12A, where an ultra-fine particle material (particles of PZT) is made to collide rapidly with a surface to be processed (surface) of the vibration plate 15 and deposited thereon, thereby forming the piezoelectric layer on the vibration plate 15.

After the piezoelectric layer 12A is thus formed on the surface of the vibration plate 15, anneal processing is performed, which is a heat treatment for assuring a sufficient piezoelectric characteristic in the piezoelectric layer 12A, and subsequently, in regions respectively overlapping on the plurality of pressure chambers 14Aa in plan view on the surface of the piezoelectric layer 12A, a plurality of individual electrode 12B are formed using a screen printing method, a vapor deposition method, a sputtering method, or the like.

Then, finally, by joining the plate assembly 18 (the nozzle plate 16, the spacer plate 17) made of synthetic resin to the lower surface of the stack 14, production of the head 3 for an ink-jet printer is completed. Note that by this joining of the plate assembly 18, the test openings 33 are closed and become unseen from the outside. Reasons of thus lately joining the plate assembly 18 in the end are that the plate assembly 18 is made of synthetic resin and hence deforms when subjected to anneal processing, and for the purpose of closing the test openings 33 after the leak test is finished. If the test openings 33 are not closed, ink enters therethrough and causes corrosion of the head, and therefore it is desirable to close the test openings 33.

Figure 9B:
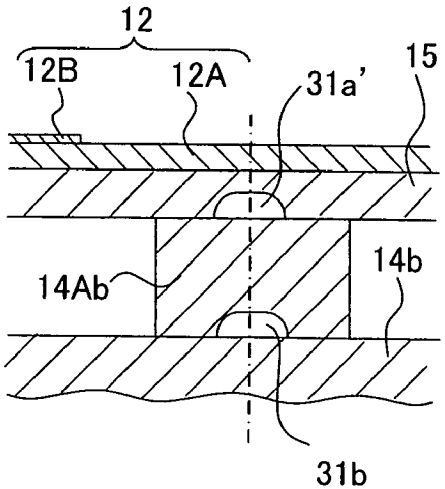
FIG. 9B is a first modification example of FIG. 9A.
Figure 9C:
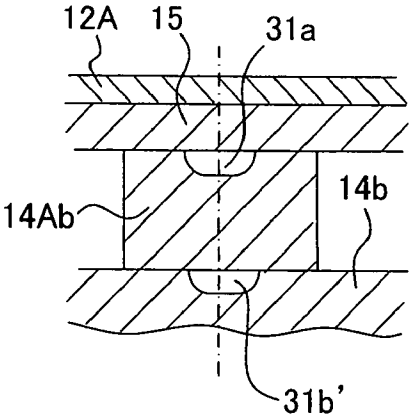
FIG. 9C is a second modification example of FIG. 9A.
Figure 9D:
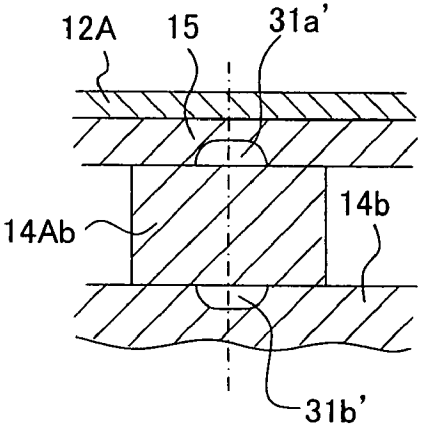
FIG. 9D is a third modification example of FIG. 9A.

In the above-described embodiment, the test grooves 31*a*, 31*b* are provided in both the upper surfaces 14Abt of the column portions 14Ab of the cavity plate 14A which are joined to the vibration plate 15 and the lower surfaces 14Abb of the column portions 14Ab of the cavity plate 14A which are joined to the base plate 14B (see FIG. 9A), but the present invention is not limited thereto. It is possible to provide test grooves 31*a*' on an upper side in a lower surface of the vibration plate 15 as shown in FIG. 9B for example, and provide test grooves 31*b*' on a lower side in an upper surface of the base plate 14B as shown in FIG. 9C for example, or provide the test grooves 31*a*' on the upper side in the lower surface of the vibration plate 15 and the test grooves 31*b*' on the lower side in the upper surface of the base plate 14B as shown in FIG. 9D. Also, when occurrence of a joint failure is biased in one of portions of the upper and the lower surfaces of the column portions 14Ab, it is also possible to provide the test grooves only on the side where the joint failure occurs. Namely, by providing the test grooves in at least one of joining surfaces of the cavity plate 14A and the vibration plate 15 or joining surfaces of the cavity plate 14A and the base plate 14B, it is possible to detect a joint failure efficiently. Note that as described above, in FIG. 9A, the test grooves are formed in the central portions of the column portions 14Ab, and the both sides of the column portions 14Ab are the solid portions. When the cavity plate is metal diffusion bonded to the vibration plate and the base plate, four corner portions of the column portions 14Ab circled by the dashed lines, which are joining surfaces of the cavity plate with the vibration plate and the base plate, receive most of the load, and these portions are adhered most strongly and thereby the cavity plate can be joined strongly to the vibration plate and the base plate. Therefore, it is possible to prevent a leak of liquid between the pressure chambers, and consequently, discharge pressures of liquid can be kept evenly between the pressure chambers. Together With this, by forming the test grooves, a leak between the cavities adjacent to each other can be tested.

Also, in the above-described embodiment, only the plates 14A to 14F constituting the stack 14 and the vibration plate 15 are formed of a metal plate, but the present invention is not limited thereto. The nozzle plate 16 and the spacer plate 17 can be formed of a metal plate as well, and in this case, metal diffusion bonding may be carried out including the nozzle plate 16 and/or the spacer plate 17 to thereby form the cavity unit. In this case, the above-described test openings are opened in the lower surface (nozzle surface) of the nozzle plate, the above-described test of leak is performed after metal diffusion bonding the vibration plate 15 with the plates 14A to 14F, 16, 17, and thereby the piezoelectric layer 12A and the individual electrode 12B are formed on a cavity unit having no leak. Also in this case, it is desirable to close the test openings.

In the foregoing, examples of applying the present invention to a head for an ink-jet printer have been explained, but forms to which the present invention can be applied are not limited thereto. For example, the present invention can be applied to a head for a liquid discharging apparatus used in various fields such as medical practice, analysis, and the like, to test a leak between pressure chambers.

What is claimed is:

1. A head for a liquid discharging apparatus which discharges a liquid, the head comprising:

a cavity unit including: a plurality of nozzles arranged in a row in a surface; a plurality of pressure chambers arranged in a row corresponding to the nozzles respectively; a liquid channel which distributes the liquid from a liquid supply hole to each of the pressure chambers and supplies the liquid to each of the nozzles; a first plate forming the pressure chambers; and second plates joined to both surfaces of the first plate respectively;

wherein column portions are provided to partition mutually adjacent pressure chambers among the plurality of pressure chambers, and test grooves are formed corresponding to the column portions in at least one of the first plate and the second plates;

and a communication groove capable of supplying air communicates with the test grooves.

2. The head for the liquid discharging apparatus according to claim 1, wherein in the cavity unit, the first plate and the second plates are joined by metal diffusion bonding.

3. The head for the liquid discharging apparatus according to claim 1, wherein each of the pressure chambers is formed of a through hole which is formed in the first plate and the second plates which are joined to the both surfaces of the first plate; and each of the test grooves has a first test groove formed in a joining surface of the first plate with one of the second plates and a second test groove formed in a joining surface of the first plate with the other one of the second plates, and the first and second test grooves communicate with the communication groove.

4. The head for the liquid discharging apparatus according to claim 3, wherein the communication groove has a first communication groove communicating with the first test groove and a second communication groove communicating with the second test groove.

5. The head for the liquid discharging apparatus according to claim 3, wherein the first test groove is formed in a surface of the first plate, and the second test groove is formed in the other surface of the first plate.

6. The head for the liquid discharging apparatus according to claim 1, wherein the test grooves are formed in at least one of a joining surface of the first plate with one of the second plates and a joining surface of the first plate with the other one of the second plates.

7. The head for the liquid discharging apparatus according to claim 4, further comprising a through passage which communicates the first communication groove and the second communication groove.

8. The head for the liquid discharging apparatus according to claim 1, wherein the test grooves are formed in the column portions by half etching.

9. The head for the liquid discharging apparatus according to claim 1, wherein the communication grooves extend in a row direction of the row of the pressure chambers on each of both sides of the pressure chambers.

10. The head for the liquid discharging apparatus according to claim 1, wherein the plurality of nozzles are formed in a nozzle plate joined to the cavity unit;

the cavity unit has a test opening which communicates with the communication groove; and the test opening is closed by the nozzle plate.

* * * * *